United States Patent [19]

Barrow et al.

[11] Patent Number: 4,802,873

[45] Date of Patent: Feb. 7, 1989

[54] METHOD OF ENCAPSULATING TFEL PANELS WITH A CURABLE RESIN

[75] Inventors: William A. Barrow, Aloha; Richard Schmachtenberg, III, Beaverton, both of Oreg.

[73] Assignee: Planar Systems, Inc., Beaverton, Oreg.

[21] Appl. No.: 104,166

[22] Filed: Oct. 5, 1987

[51] Int. Cl.[4] ..... H05B 33/04

[52] U.S. Cl. ..... 445/6; 445/24

[58] Field of Search ..... 313/506, 509, 512; 445/6, 24, 25

[56] References Cited

U.S. PATENT DOCUMENTS

| | | | |
|---|---|---|---|
| 3,213,515 | 10/1965 | Koury et al. | 445/6 |
| 4,203,792 | 5/1980 | Thompson | 313/512 X |
| 4,213,074 | 7/1980 | Kawaguchi et al. | 313/512 X |
| 4,217,014 | 8/1980 | Piascinski | 445/6 |
| 4,446,399 | 5/1984 | Endo et al. | 313/512 X |
| 4,447,757 | 5/1984 | Kawaguchi et al. | 313/512 X |
| 4,578,617 | 3/1986 | Kerr, III et al. | 313/512 |
| 4,719,385 | 1/1988 | Barrow et al. | 313/506 |

*Primary Examiner*—Kenneth J. Ramsey

*Attorney, Agent, or Firm*—Chernoff, Vilhauer McClung & Stenzel

[57] ABSTRACT

A solid filler material is used to encapsulate active TFEL components supported by a substrate and disposed within a cavity. The cavity is created by affixing a rear cover plate to the substrate. The filler material is injected into the cavity as a liquid but cures to a solid under the influence of heat. This provides an effective moisture barrier and enhances the structural integrity of the panel rendering it immune to problems caused by changes in air pressure or caused by vibration.

4 Claims, 1 Drawing Sheet

METHOD OF ENCAPSULATING TFEL PANELS WITH A CURABLE RESIN

BACKGROUND OF THE INVENTION

The following invention relates to a method and a construction for TFEL panels utilizing a solid filler material within the sealed cavity housing the active TFEL components.

TFEL panels are extremely sensitive to moisture. If such panels are operated without a protective cover plate in an environment containing moisture, the thin films making up the AC TFEL device tend to delaminate, leaving dark regions in the display area. This problem is progressive as long as the panel is operated in the moist environment and it is irreversible. If operated long enough in such an environment, the entire active area becomes dark.

Previous solutions to this problem have involved the encapsulation of the active TFEL area of the display with a cavitated cover plate and the filling of the intervening cavity with silicone oil. This technique is shown in the U.S. Pat. Nos. to Kawaguchi et al. 4,213,074, Endo et al. 4,446,399 and Kawaguchi et al. 4,447,757.

The silicone oil utilized in the aforementioned patents does not provide moisture protection but avoids mechanical problems associated with the cavity being filled with gas (air) or being evacuated. The oil also promotes self-healing for point defects which are small short circuits between the phosphor and one of the electrode layers. The moisture protection function is provided by the rear cover plate and a perimeter adhesive seal. If this seal is broken, or is not intact as a moisture barrier, the moisture-induced degradation of the panel will proceed. Mechanical problems associated with gas-filled or evacuated cavities include the fracturing of the cover plate or substrate at high or low ambient pressures (such as high altitude or submarine environments) and excessive acoustical vibration resulting from the piezoelectric effect in the ZnS phosphor layer of the device. Other problems which may be encountered, if the panels are installed in aircraft, include the actual shattering of the glass due to mechanical vibration or stress. In the event of a break in the rear cover plate the silicone oil in oil-filled devices can leak out and damage the electrical components below the panel.

SUMMARY OF THE INVENTION

An AC matrix addressed TFEL panel comprises active electroluminescent components supported on a substrate. The active electroluminescent components may comprise, for example, an electroluminescent layer sandwiched between a pair of insulating layers which are in turn sandwiched between orthogonally disposed layers of scanning and data electrodes. A rear cover is attached to the substrate so as to define a cavity within which are enclosed the active electroluminescent components. A solid material is used as a filler which fills the excess of the cavity not occupied by the active electroluminescent components to form a moisture barrier encapsulating the active electroluminescent components and to provide increased structural rigidity.

The solid filler provides the panel with greater structural integrity, resistance to vibration, and changes in atmospheric pressure. Additionally, the solid filler may be injected into the cavity initially in a liquid form and may cure to a solid form as a result of being subjected to heat generated by the active electroluminescent components during the initial "burn in" period. "Burn in" is a procedure commonly used in the manufacture of TFEL panels during which the panel is fully illuminated for a period of about 24 hours. The liquid may comprise a silicone compound which also performs the self-healing function of inhibiting the propagation of point defects which sometimes occur during burn in. Thus, the filler material has the property that it begins as a liquid during the initial part of the burn in period, after which it cures to a solid under the influence of the heat generated during this time.

It may also be desirable to have the material dyed black so as to minimize reflections from the rear cover and to provide a background of maximum constrast for the active display area of the panel.

It is a primary object of this invention to provide a construction and method of manufacture for an AC TFEL panel which employs a solid filler material filling a cavity housing active electroluminescent components so as to provide a moisture barrier, maximize the structural integrity of the panel as a whole, and prevent the propagation of point defects.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
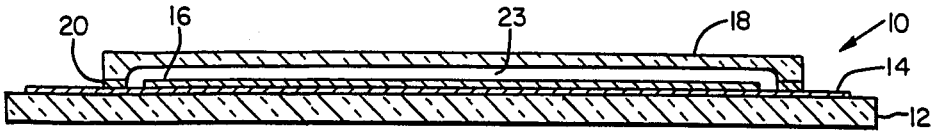
FIG. 1 is a side cut-away view of a TFEL panel constructed according to the present invention.

Referring to FIG. 1 a TFEL panel 10 includes a substrate 12 upon which is deposited a transparent electrode layer 14. Other active TFEL components comprising a thin film phosphor sandwiched between a pair of insulators and covered by a set of rear electrodes are represented by active TFEL layer 16. This type of construction is well known in the art, as illustrated in copending patent application Ser. No. 727,663 assigned to the same assignee. A rear cover plate 18 comprises plate with a shallow depression which is affixed to the electrode layer 14 and substrate 12 by means of a suitable adhesive 20. This defines a cavity 23.

Figure 4:
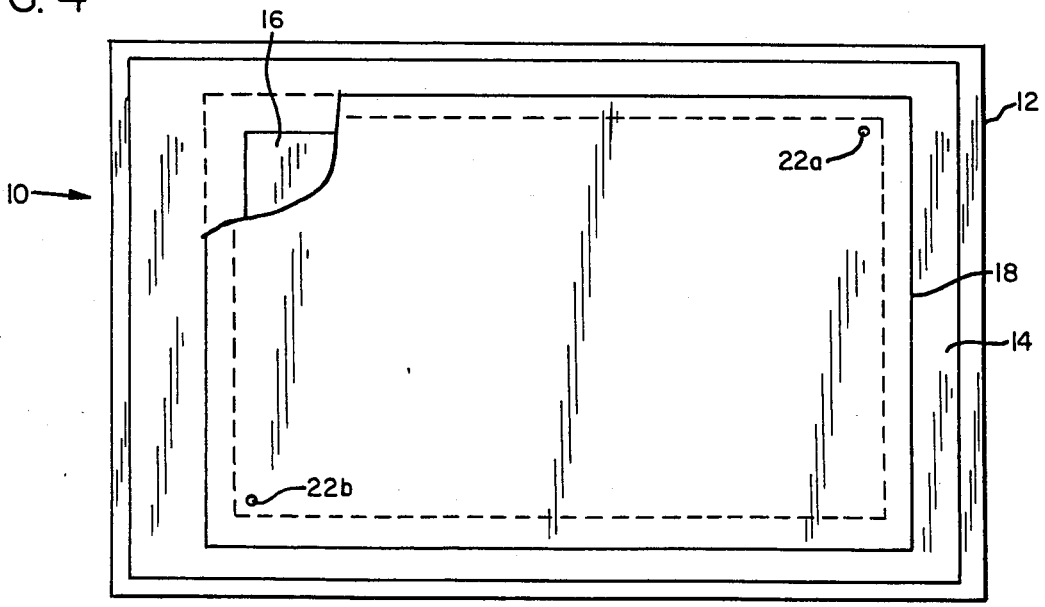
FIG. 4 is a top view of the TFEL panel of FIG. 1 additionally including holes in the back cover plate for the injection of filler material.
Figure 5:
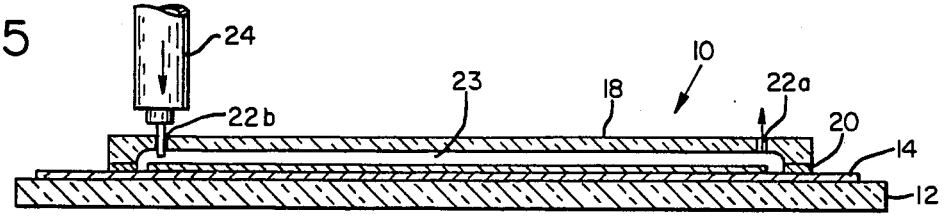
FIG. 5 is a side cut-away view of the TFEL panel of FIG. 4 additionally showing the method by which the filler material is injected into the cavity defined by the rear cover.

Referring now to FIGS. 4 and 5 the rear cover plate 18 includes two small holes **22*a* and 22*b*. A pump 24 or other suitable injector injects a silicone compound through a hole 22*b* into the cavity 23. The air inside the cavity 23 is forced out of hole 22*a* as indicated by the arrow in FIG. 5. Once the entire cavity 23 has been injected with the compound the holes 22*a* and 22*b*** are plugged.

The compound is a silicone compound which polymerizes under the influence of heat. One such suitable compound is General Electric dielectric silicone fluid, fifteen parts of which is mixed with ten parts of a GE resin known as "Resin J" which is sold with the silicone fluid, and one part catalyst which is a compound also sold with the GE dielectric silicone fluid. An alternative compound which may be used is Silicone Semigel Type C which is manufactured by Transene Company, Inc. of Rowley, Mass.

Both of the above-mentioned compounds are initially in a liquid state but both cure to a solid under the influence of heat. After the silicone compound is injected into the cavity 23, the panel is turned on for a period of time referred to as the "burn in" period. During this time all electrodes are energized and the panel is fully lit. Any point defects which may occur are localized by the liquid silicone. Thus, during the initial burn in period, the filler material retains the advantages of the silicone oils used in conventional TFEL panels which promote the self-healing of point defects. Self-healing is a property of the top electrode layer to melt away from the region of a short circuit between the electrode layer and the phosphor layer thus forming a small hole in the electrode layer. This creates an open circuit which does not adversely affect the electrical characteristics of the panel, and which confines the point defect to a very small local area.

The burn in time of the panel lasts for about 24 hours, during which time the silicone filler material cures to a hardened state. Thus, after the burn in period, the entire cavity 23 is filled with a solid material which encapsulates the active components and thus greatly enhances the structural integrity of the panel as a whole.

Figure 2:
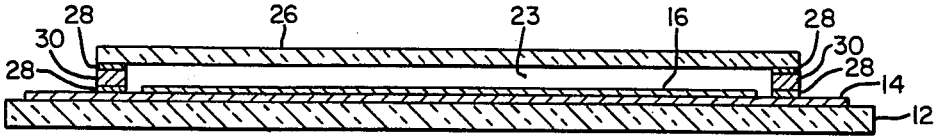
FIG. 2 is a side cut-away view of an alternative construction of the TFEL panel of the present invention.
Figure 3:
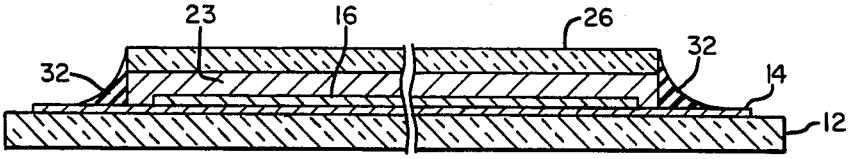
FIG. 3 is a partial side cut-away view of a second alternative construction of the TFEL panel of the present invention.

Alternative ways of constructing the panel are shown in FIGS. 2 and 3. In FIG. 2 a rear cover plate 26 is a flat sheet of glass which is secured to the transparent electrode layer 14 and substrate 12 by a spacer 30 sandwiched by adhesive layers 28.

In FIG. 3 flat plate 26 is secured to the transparent electrode layer 14 by means of a glass frit seal 32. Other methods of securing the cover plate 26 to the substrate 12 may be employed. This seal is the primary moisture barrier and it is important that it be as watertight as possible.

The silicone oils of the prior art provided little in the way of moisture protection if the barrier formed at the connection between the rear cover plate and the substrate 12 were breached by moisture. However, with the solid filler material of the invention, greater moisture protection is provided for the active TFEL layer 16. Additionally, the silicone compounds suggested for use with the invention herein have adhesive properties so that in the event of total breakage of the panel, the glass shards will stick to the filler material, thus posing less of a hazard to operator safety.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of manufacturing a matrix addressed AC TFEL device, said device comprising a first transparent electrode layer deposited on a glass substrate and active electroluminescent components deposited on said transparent electrode layer, comprising the steps of:

(a) affixing a rear cover to said substrate, said cover thereby forming a sealed cavity enclosing said active electroluminescent components;

(b) filling said cavity with a material initially having a liquid state which cures to a solid state;

(c) energizing said active electroluminescent components so as to completely illuminate said device for a predetermined time; and (d) wherein said liquid material cures to said solid material within said predetermined time.

2. The method of claim 1 wherein said cavity is filled by injecting said liquid material through a small hole in rear cover after said rear cover has been affixed to said substrate and then sealing said hole.

3. The method of claim 1 wherein said liquid material is a silicone compound which polymerizes under the influence of heat.

4. The method of claim 3 wherein the silicone compound is dyed black.

* * * * *